US011047089B2

(12) United States Patent
Brown et al.

(10) Patent No.: US 11,047,089 B2
(45) **Date of Patent: *Jun. 29, 2021**

(54) CLEANING AND WASHING DOWN AND/OR FEATHERS

(71) Applicant: NIKWAX LIMITED, Wadhurst (GB)

(72) Inventors: Nicholas Brown, Ticehurst (GB); David John Ellis, Burgess Hill (GB)

(73) Assignee: Nikwax Limited, East Sussex (GB)

( * ) Notice: Subject to any disclaimer, the term of this patent is extended or adjusted under 35 U.S.C. 154(b) by 307 days.

This patent is subject to a terminal disclaimer.

(21) Appl. No.: 15/574,610

(22) PCT Filed: May 17, 2016

(86) PCT No.: PCT/GB2016/051412

§ 371 (c)(1),
(2) Date: Nov. 16, 2017

(87) PCT Pub. No.: WO2016/185194

PCT Pub. Date: Nov. 24, 2016

(65) Prior Publication Data

US 2018/0135238 A1 May 17, 2018

(30) Foreign Application Priority Data

Apr. 25, 2016 (GB) ..... 1607177

(51) Int. Cl.

| | |
|---|---|
| ***D06L 1/16*** | (2006.01) |
| ***B68G 3/10*** | (2006.01) |
| ***C11D 1/66*** | (2006.01) |
| ***C11D 3/20*** | (2006.01) |
| ***C11D 11/00*** | (2006.01) |
| ***D06M 19/00*** | (2006.01) |
| ***D06L 1/12*** | (2006.01) |
| ***D06M 15/564*** | (2006.01) |
| ***D06M 15/277*** | (2006.01) |
| ***D06M 13/02*** | (2006.01) |
| ***D06M 15/643*** | (2006.01) |

(52) U.S. Cl.

CPC ..... *D06L 1/16* (2013.01); *B68G 3/10* (2013.01); *C11D 1/662* (2013.01); *C11D 3/2079* (2013.01); *C11D 3/2086* (2013.01); *C11D 11/0017* (2013.01); *C11D 11/0064* (2013.01); *D06L 1/12* (2013.01); *D06M 13/02* (2013.01); *D06M 15/277* (2013.01); *D06M 15/564* (2013.01); *D06M 15/643* (2013.01); *D06M 19/00* (2013.01); *D06M 2200/12* (2013.01)

(58) Field of Classification Search

CPC .... D06L 1/16; D06L 1/12; B68G 3/10; C11D 1/662; C11D 3/2079; C11D 3/2086; C11D 11/0017; C11D 11/0064; D06M 19/00; D06M 15/564; D06M 15/277; D06M 15/643; D06M 13/02; D06M 2200/12

See application file for complete search history.

(56) References Cited

U.S. PATENT DOCUMENTS

| | | | | | |
|---|---|---|---|---|---|
| 3,475,112 | A | | 10/1969 | Mahall | |
| 3,993,830 | A | * | 11/1976 | Dickson | C11D 3/0036 442/93 |
| 5,306,435 | A | * | 4/1994 | Ishikawa | C14C 9/00 252/8.57 |
| 6,159,548 | A | * | 12/2000 | Moody | D06M 15/263 427/389.9 |
| 2002/0019328 | A1 | * | 2/2002 | Schroeder | C11D 3/001 510/439 |
| 2002/0161116 | A1 | | 10/2002 | Yu | |

FOREIGN PATENT DOCUMENTS

| | | | | | |
|---|---|---|---|---|---|
| CN | 103696224 | A | | 4/2014 | |
| CN | 104532556 | A | | 4/2015 | |
| DE | 3631582 | A1 | | 4/1988 | |
| EP | 2267216 | | * | 6/2009 | D06M 13/17 |
| EP | 2267216 | A1 | | 12/2010 | |
| GB | 2143866 | A | | 2/1985 | |
| RU | 2244677 | C1 | | 1/2005 | |
| SU | 118735 | | | 6/1958 | |

OTHER PUBLICATIONS

International Search Report and Written Opinion for PCT/GB2016/051412 dated Sep. 6, 2016.

* cited by examiner

*Primary Examiner* — Amina S Khan
(74) *Attorney, Agent, or Firm* — Heslin Rothenberg Farley & Mesiti P.C.

(57) ABSTRACT

The present invention relates to a process for cleaning and/or washing down and/or feathers comprising: (a) mixing the down and/or feathers with a solution of an alkyl polyglucoside; (b) optionally adding simultaneously or sequentially a solution of a Group 4 metal salt to the mixture of (a); (c) removing excess liquid; and (d) optionally drying the down and/or feathers. Down and/or feathers prepared according to such a process are also disclosed. The invention additionally relates to a down and/or feather washing and/or cleaning composition for rendering the down and/or feathers hydrophobic comprising a solution of an alkyl polyglucoside, optionally a solution of a Group 4 metal salt, and a water-repellent treatment. The invention further relates to a kit for cleaning and/or washing down and/or feathers and rendering the down and/or feathers water repellent.

15 Claims, No Drawings

CLEANING AND WASHING DOWN AND/OR FEATHERS

CROSS REFERENCE TO RELATED APPLICATIONS

This application is a U.S. National Phase filing under 35 U.S.C. § 371 of International Application PCT/GB2016/051412, filed May 17, 2016, and published as WO 2016/185194 A1 on Nov. 24, 2016. PCT/GB2016/051412 claims priority from Great Britain application numbers 1508522.8, filed May 18, 2015, and 1607177.1, filed Apr. 25, 2016. The entire contents of each of these applications are hereby incorporated herein by reference.

TECHNICAL FIELD

The present invention relates to an improvement in a process for cleaning and/or washing down and/or feathers. In particular it relates to a process for cleaning or washing without inhibiting the effective application of water-repellent treatments to the down and/or feathers during or after the washing process.

BACKGROUND

Down and feathers for use in such items as warm outdoor clothing, sleeping bags and duvets are sourced from water fowl, such as ducks and geese. They are required to be processed in order to become an outstanding insulating material. When they arrive in the unprocessed state at the down processor they are usually contaminated with fats and oils, proteinaceous materials and even excrement. They therefore need to be thoroughly cleaned in order for them to be hygienic, minimise odours and to optimise insulating properties. Additionally, in the cleaning and washing process it is important that dust should be removed that could cause an allergic reaction.

The usual process for washing down and feathers comprises dropping a load of down and/or feathers, for example 200 kg, into a washer that has been filled with warm water. A biodegradable detergent or strong surfactant, such as an alcohol ethoxylate or polyethylene glycol detergent, is added to ensure a thorough cleaning. A degreaser may also be added. The down is then rinsed with clean water up to 15 times to completely process and rinse away fine dust and residue.

The disadvantage of this process is that the down is frequently left extremely hydrophilic, in part because the natural hydrophobic oils have been removed and in part because the surfactant has become physically adsorbed onto the down surface. If the down is very dirty it is often necessary to use more surfactant, resulting in a higher level of surfactant left on the down. This renders any subsequent hydrophobic treatment less effective.

The cleaned and washed down and feathers are then finally sent to the centrifuge which removes the bulk of the water, after which they are dried in a steam dryer.

The hydrophilic nature of normally processed down makes it extremely vulnerable to wetting when used in an outdoor context, e.g. in a down-filled jacket or sleeping bag.

Properly washed and dried down ensures maximum loft of the down. Each down cluster traps air, which increases warmth. Washing the plumes ensures that each filament can properly overlap to form a protective layer of non-conducting still air that keeps warmth in and cold out. Thus the insulation power of down fillings relies on the capacity of down to trap air. If down gets wet it clumps together, causing it to lose loft as it cannot trap air effectively. Saturated down is also slow to dry.

Whilst down is known to be the most effective insulating material for use in outdoor clothing, its vulnerability to wetting conferred by prior art processes generally limits the usability of down-filled garments and articles to their use in drier environments and for low activity levels.

SUMMARY OF INVENTION

It has now been found that by using one of a specific range of non-ionic surfactants, i.e. alkyl polyglucosides, for effective cleaning and washing of fresh contaminated down and/or feathers can reduce the amount of rinse-water required.

In addition, and typically when the process further includes the simultaneous or subsequent application of a Group 4 metal salt, the resulting down can be more effectively made hydrophobic after being subjected to a water-repellent treatment.

The process can include a period of high temperature drying, in which the resulting cleaned and washed down may be efficiently rendered hydrophobic using a suitable hydrophobic treatment.

The process of the invention may be used for the reprocessing of previously processed down, which may then be rendered hydrophobic.

According to a first aspect of the invention, there is provided a process for cleaning and washing down and/or feathers comprising mixing the down and/or feathers with a solution of an alkyl polyglucoside.

The process may also include the simultaneous or sequential addition of a solution of a Group 4 metal salt to the mixture produced.

After treatment, excess liquid is removed, and the down and/or feathers are dried at a temperature of at least 100° C.

According to a second aspect of the invention, there is provided water-repellent down and/or feathers prepared by the process described above.

According to a third aspect of the invention, there is provided a down and/or feather washing and/or cleaning composition for rendering the down/or feathers hydrophobic, the composition comprising a solution of an alkyl polyglucoside and a water-repellent treatment, and optionally a solution of a Group 4 metal salt.

According to a fourth aspect of the invention, there is provided a kit for cleaning and/or washing down and/or feathers and rendering the down and/or feathers water repellent, comprising a first closed vessel containing a solution of a polyglucoside comprising an alkyl group, R, having from 4 to 20 carbon atoms and having a formula of $H(C_6H_{10}O_5)_nOR$ where n is at least 1, optionally a second closed vessel containing a solution of a Group 4 metal salt, wherein the Group 4 metal is selected from the group consisting of titanium, zirconium and hafnium and the salt is a carboxylic salt selected from the group consisting of acetate, acetyl acetonate, acrylate, lactate and stearate, and a third vessel containing a water repellent treatment selected from the group consisting of waxes, silicones, stearic acid-melamine based systems, reactive polyurethanes, dendrimer chemistries and hydrophobic alkyl chain fluorinated compounds such as polymers based upon C6 and C8 fluorotelemer derived acrylate, together with instructions for use.

The process of the invention is usually carried out at ambient pressure.

DESCRIPTION OF EMBODIMENTS

The process comprises treating down and/or feathers with an alkyl polyglucoside. The use of alkyl polyglucosides compared to other, conventional non-ionic surfactants such as polyglycols, is advantageous as less rinse-water is required to remove residual oil and fat. In addition, it has been found that the use of alkyl polyglucoside in the washing/cleaning treatment of the down and/or feathers renders any subsequent water-repellant treatment significantly more effective, particularly in combination with treatment with a Group 4 metal salt.

The process may comprise the additional step of adding a water-repellent treatment to the down and/or feathers. This addition may take place after drying. Alternatively, the water repellent reagent may be added with the Group 4 metal salt, or the Group 4 metal salt can form part of a water repellent emulsion. Suitable water repellent emulsions include waxes, silicones, stearic acid-melamine based systems, reactive polyurethanes, dendrimer chemistries, hydrophobic alkyl chain fluorinated compounds such as polymers based upon C6 and C8 fluorotelomer derived acrylates.

During the cleaning and washing process the alkyl polyglucoside and the Group 4 metal salt may be added to the down and/or feathers simultaneously.

Alkyl polyglycosides are a class of non-ionic surfactants derived from sugars and fatty alcohols. When derived from glucose they are known as alkyl polyglucosides. The alkyl polyglucoside has a hydrophilic end to the molecule having a formula $(C_6H_{10}O_5)_n$, where n is at least 1, for example at least 2. In embodiments, n is less or equal to 20. The alkyl polyglucoside also has a hydrophobic end to the molecule comprising an alkyl group, R, typically having from 4 to 20 carbon atoms, preferably from 8 to 16 carbon atoms. In embodiments, the alkyl group may comprise 4 to 6 carbons, 8 to 10 carbons, 8 to 12 carbons, 10 to 12 carbons, 10 to 16 carbons or 16 to 18 carbons. The alkyl polyglucoside can be represented overall by the formula $H(C_6H_{10}O_5)_nOR$:

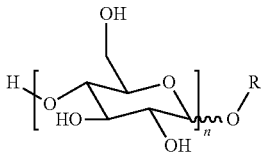

Alkyl polyglucosides are produced by direct synthesis from higher monofunctional alcohols and powdered glucose, in particular anhydrous glucose or glucose monohydrate in the presence of an acid catalyst at an elevated temperature. The reaction chamber is maintained at reduced pressure.

Alkyl polyglucosides are available commercially from The Dow Chemical Company (USA), Seppic SA (France) and BASF (Germany). They are usually available as a solution in water of about 30% w/w or higher. For washing down and/or feathers the concentration of the alkyl polyglucoside would typically be in the range of 0.1% to 0.5% w/w in water.

Alkyl polyglucosides may be combined with other surfactants and, in particular, alkali soaps.

The Group 4 metal salt preferably comprises a titanium, zirconium or hafnium salt of a carboxylic acid. The carboxylic acid salt may be selected from acetate, acetylacetonate, acrylate, lactate and stearate. The most preferred Group 4 metal salt is zirconium acetate. Suitable salt preparations are available commercially from MEL Chemicals (UK), Dixon Chew (UK) and Dorf-Ketal Chemicals (India).

Zirconium acetate is available as a 22% w/w solution in water and acetic acid.

When used, the ratio of the Group 4 metal salt, preferably zirconium acetate, to the alkyl polyglucoside is preferably in the region of 10:1 to 15:1. However, this ratio only relates to the residual alkyl polyglucoside, that is, if the treatment with the alkyl polyglucoside is followed by a number of rinses with water, the actual concentration of alkyl polyglucoside present on the down and/or feathers when the Group 4 metal salt is added would be lower than the initial level added.

When the Group 4 metal salt and alkyl polyglucoside are applied to the down and/or feathers simultaneously it is important that they are applied in a ratio of 10:1 to 15:1.

The group 4 metal salt is advantageous to the process when a water repellent treatment is being applied. The APG, even after rinsing, still remains on the down, and will provides a semi-durable wetting effect, which can negatively affect adherence of a water-repellent hydrophobic coating. The Group 4 metal salt can deactivate this wetting effect after the down is heated for the purpose of drying, ensuring that a hydrophobic coating can be effectively applied.

Following the addition of the alkyl polyglucoside preparation, the water-repellant treatment can be applied. The Group 4 metal salt may form part of the water-repellent treatment, or the down/feathers can be treated with Group 4 metals salt before the water-repellent treatment.

In the water-repellent treatment, the chemicals are allowed to react for a period of time, for example 20 minutes. This time may vary and is dependent on the time taken to fully distribute the chemicals throughout the treatment vessel. The excess liquid is then removed. The down and/or feather mixture is then dried at a temperature of from 100° C. to 160° C., preferably from 100° C. to 140° C., most preferably from 110° C. to 135° C. Alternatively a water-repellent treatment may be added after the cleaned down and/or feathers have been dried, in order to render them hydrophobic. Suitable water repellent treatments include waxes, silicones, stearic acid-melamine based systems, reactive polyurethanes, dendrimer chemistries and hydrophobic alkyl chain fluorinated compounds such as polymers based upon C6 and C8 fluorotelemer-derived acrylates.

Water-repellent down and/or feathers can be prepared by the method described above.

The composition that can be used as a down and/or feather washing and/or cleaning composition, for rendering the down/or feathers hydrophobic, can comprise a solution of an alkyl polyglucoside. This can also include a solution of a Group 4 metal salt and a water-repellent treatment, or the Group 4 metal salt and water-repellent treatment can be provided separately.

The composition preferably comprises an alkyl polyglucoside having an alkyl group with from 4 to 20 carbon atoms, preferably 8 to 16 carbon atoms and the glucoside has a formula $(C_6H_{10}O_5)_n$ where n is at least 1. The Group 4 metal salt is a carboxylic acid salt of a Group 4 metal selected from titanium, zirconium or hafnium, and the water-repellent treatment is selected from waxes, silicones, stearic acid-melamine based systems, reactive polyurethanes, dendrimer chemistries and hydrophobic alkyl chain fluorinated compounds such as polymers based upon C6 and C8 fluorotelomer derived acrylates.

A kit for cleaning and/or washing down and/or feathers and rendering the down and/or feathers water repellent can also be provided, comprising a first closed vessel containing a solution of an alkyl polyglucoside comprising an alkyl group, R, having from 4 to 20 carbon atoms and having a formula of $H(C_6H_{10}O_5)_nOR$ where n is at least 1, optionally a second closed vessel containing a solution of a Group 4 metal salt, wherein the Group 4 metal is selected from the group consisting of titanium, zirconium and hafnium and the salt is a carboxylic salt selected from the group consisting of acetate, acetyl acetonate, acrylate, lactate and stearate and a third vessel containing a water repellent treatment selected from the group consisting of waxes, silicones, stearic acid-melamine based systems, reactive polyurethanes, dendrimer chemistries and hydrophobic alkyl chain fluorinated compounds such as polymers based upon C6 and C8 fluorotelemer derived acrylate, together with instructions for use.

The process of the present invention has several advantages over previously used processes. Firstly, the surfactant is efficiently rendered inactive, enabling the cleaned down and/or feathers to be rendered more hydrophobic using a suitable water repellent treatment. Such treated down and/or feathers can then be used in outdoor clothing and the like. Secondly, the process provides an increase in the fill power of the treated down resulting in better insulation. Fill power is the ability of down to loft and regain its original volume after being compressed during shipping, storage or use. The process has the added advantage of using considerably less water as fewer rinses are required to remove the alkyl polyglucoside as it is rendered inactive by using the Group 4 metal salt.

A further unexpected advantage of using an alkyl polyglucoside, optionally together with a Group 4 metal salt, followed by drying at a temperature of at least 100° C., in accordance with the process of this invention, is that the amount of free dust in the resulting processed down and/or feathers is reduced. This can readily be seen from the reduction in turbidity.

Turbidity measures the particles suspended in solution of water after feather and down fill material is rinsed. Turbidity detects both organic and inorganic dust and other foreign material.

In order to measure turbidity the down and/or feathers are mixed with water in a jar for a period of 15 minutes. After this, the water is strained from the jar through a 200 mesh sieve and put into a metre high glass cylinder with a cross marked on the base of the cylinder. The height of the water column which obscures the view of the cross from above is a measure of turbidity. A turbidity measurement of 400 mm+ is considered hypoallergenic.

The present invention will be further described by way of reference to the following example.

Example 1

100 kilograms of unprocessed goose down were loaded into a suitable side-on cylindrical vessel provided with means of heating via a steam jacket and a radial axial stirrer allowing for complete agitation of the contents. The vessel was then filled with 2000 litres of a 0.5% w/w solution of a mixture of alkyl polyglucosides based on natural fatty alcohol C12-C14 (Glucopon 600 CUSP, BASF Chemicals) in deionised water. Following filling, the contents of the vessel were heated to a temperature of 37° C. The contents were then agitated over the course of 20 minutes before the excess liquor was drained from the vessel.

The vessel was then refilled with 2000 litres of deionised water and the contents were again heated to 37° C. Rinsing of the down was then carried out by agitation of the vessel contents for 30 minutes before the excess liquor was drained.

The vessel was refilled again with 2000 litres of deionised water and the contents were first acidified to a pH of 4.0 by the addition of 2.5 kg of acetic acid (80% solution in water). Subsequently, 2 kg of oil in water macroemulsion containing 17.5% w/w polydimethylsiloxane, viscosity 100 centistoke (Dow Corning 200 Fluid, 100CST) and 0.5 kg of zirconium acetate solution (22% wt $ZrO_2$) (Mel Chemicals) were added. The contents of the vessel were heated to 37° C. and the down was washed in the liquor by agitation of the vessel contents for 30 minutes. After this time, the excess liquor was drained.

Following drainage of the vessel, the treated down was transferred to a centrifugal extractor to allow for further excess liquor to be removed. Finally, the down was dried at a temperature of 135° C. for a period of 65 minutes. The resultant treated down showed a test time in excess of 800 minutes when subjected to the IFDB (International Down and Feather Bureau) Hydrophobic Shake Jar standard test (18A).

Example 2

120 kilograms of unwashed duck down were loaded into a suitable side-on cylindrical vessel with a radial axial stirrer allowing for complete agitation of the contents. To provide for effective cleaning the vessel was charged with 1000 litres of 0.2% w/w solution of a mixture of alkyl polyglucosides based on a natural fatty alcohol C8-C10 (Glucopon 225 DK, BASF Chemicals) in deionised water. The contents were agitated for 5 minutes before the excess liquor was drained. The excess cleaning agent and residual soiling were then removed from the down by means of 3 subsequent rinsings; whereby the vessel was filled with 1000 litres of deionised water, agitated for 5 minutes and then drained. Following the final rinse, the down was transferred to a centrifugal extractor to allow for excess liquor to be removed. Finally, the down was dried at a temperature of 120° C. for 15 minutes before being compressed and stored prior to final finishing. This is referred to below as batch A.

To provide a batch for comparison, 120 kilograms of unwashed duck down from the same batch was processed using the same process, but substituting the 1000 litres of 0.2% w/w solution of alkyl polyglucoside solution for a solution of 1000 litres of 0.25% w/w solution of a PEG-based non-ionic surfactant (Dehaclin WP-20, CHT Bezema). Other quantities and process times were the same as above. The finished batch is referred to below as batch B.

100 kilograms of down from batch A was loaded into a suitable side-on cylindrical vessel with a radial axial stirrer allowing for complete agitation of the contents. The vessel was then filled with 1000 litres of cold deionised water and the pH was adjusted to a value of between pH 9.0 to 9.5 by the addition of 800 ml of a 10% w/w solution of sodium hydroxide. Following the pH adjustment, 8 kg of NHD Treatment (Nikwax Limited, comprising a zirconium salt and polysiloxane) was added to the vessel; which was then agitated for a period of 10 minutes before the excess liquor was drained. To rinse the contents, the vessel was then twice refilled with 1000 litres of cold deionised water and agitated for 2 minutes before excess liquor was drained. After the second rinse, the excess liquor was drained and the vessel was refilled with 1000 litres of cold deionised water and the pH was adjusted to a value of pH 5.0 by the addition of 600 ml of 80% acetic acid. Following the pH adjustment, 2 kg of NHD Finisher (Nikwax Limited, comprising a zirconium salt) was added to the vessel; which was then agitated for 5 minutes before the excess liquor was drained. The down was then dried at a temperature of 130° C. for 30 minutes. The finished batch is referred to below as batch A1.

100 kilograms of down from batch B was loaded into a suitable side-on cylindrical vessel with a radial axial stirrer allowing for complete agitation of the contents. The vessel was then filled with 1000 litres of cold deionised water and the pH was adjusted to a value of between pH 9.0 to 9.5 by the addition of 800 ml of a 10% w/w solution of sodium hydroxide. Following the pH adjustment, 8 kg of NHD Treatment (Nikwax Limited) was added to the vessel; which was then agitated for a period of 10 minutes before the excess liquor was drained. To rinse the contents, the vessel was then twice refilled with 1000 litres of cold deionised water and agitated for 2 minutes before excess liquor was drained. After the second rinse, the excess liquor was drained and the vessel was refilled with 1000 litres of cold deionised water and the pH was adjusted to a value of pH 5.0 by the addition of 600 ml of 80% acetic acid. Following the pH adjustment, 2 kg of NHD Finisher (Nikwax Limited) was added to the vessel; which was then agitated for 5 minutes before the excess liquor was drained. The down was then dried at a temperature of 130° C. for 30 minutes. The finished batch is referred to below as batch B1.

All four batches of processed down were evaluated using the IFDB (International Down and Feather Bureau) Hydrophobic Shake Jar standard test (18A). The results are shown in Table 1 below.

In this test, the time that the down/feathers stay suspended in water is related to their hydrophobicity. Shorter times represent more hydrophilic properties, which cause the down/feathers to sink in the water. Longer times indicate higher hydrophobicity, in which the feathers are better able to float or remain suspended in the water.

TABLE 1

| Hydrophobic Shake Jar Test Results | |
|---|---|
| Batch | Observed Shake Time (minutes) |
| A | 18 |
| A1 | >1000 |
| B | 18 |
| B1 | 36 |

These results demonstrate that water-repellent treatment is substantially improved when down is washed using polyalkylglucoside, compared to a conventional polyglycol nonionic surfactant.

Example 3

60 kilograms of unwashed goose down were loaded into a suitable side-on cylindrical vessel with a radial axial stirrer allowing for complete agitation of the contents. The vessel is charged with 500 litres of cold water and 2 kg of the alkyl polyglucoside solution referred to in Example 2 are added. The contents were agitated for 5 minutes before the excess liquor was drained. The excess cleaning agent and residual soiling were then removed from the down by means of 3 subsequent rinsings; whereby the vessel was filled with 500 litres of deionised water, agitated for 5 minutes and then drained. Following the final rinse, the down was transferred to a centrifugal extractor to allow for excess liquor to be removed. Finally, the down was dried at a temperature of 120° C. for 15 minutes before being compressed and stored prior to final finishing. This is referred to below as batch A.

To provide a batch for comparison, 60 kilograms of unwashed goose down from the same batch were loaded into a suitable side-on cylindrical vessel with a radial axial stirrer allowing for complete agitation of the contents. The vessel was charged with 500 litres of cold water and 2.5 kg of Dehaclin WP-20 (CHT Bezema) were added. The contents were agitated for 5 minutes before the excess liquor was drained. The excess cleaning agent and residual soiling were then removed from the down by means of 6 subsequent rinsings; whereby the vessel was filled with 500 litres of deionised water, agitated for 5 minutes and then drained. Following the final rinse, the down was transferred to a centrifugal extractor to allow for excess liquor to be removed. Finally, the down was dried at a temperature of 120° C. for 15 minutes before being compressed and stored prior to final finishing. This is referred to below as batch B.

Each batch of down was analysed for its residual fat and oil content by reference to BS EN 1163:1997 (Feather and down. Test methods. Determination of the oil and fat content). The extraction was carried out using Petroleum Ether 60/80 as the extraction solvent. An additional sample of the unwashed down was analysed as a control. This is referred to as batch C. The results are shown in Table 2 below.

TABLE 2

| Batch | Fat & Oil Content (% w/w) |
|---|---|
| A | 8.06 |
| B | 6.13 |
| C | 12.17 |

These results demonstrate that the use of poly alkylglucoside is able to reduce the amount of water used in rinsing the down after cleaning or washing, compared to using a conventional polyglycol surfactant.

The invention claimed is:

1. A down and/or feather washing and/or cleaning composition for rendering the down and/or feathers hydrophobic, the composition comprising a combination of:

a) a solution of an alkyl polyglucoside wherein the alkyl polyglucoside comprises a hydrophilic end to the molecule with a formula $(C_6H_{10}O_5)n$, where n is at least 1, and a hydrophobic end to the molecule comprising an alkyl group having from 8 to 16 carbon atoms;

b) a solution of a salt of titanium, zirconium or hafnium, wherein the salt is acetate or lactate; and c) a water-repellent treatment selected from polysiloxanes, stearic acid melamine systems, reactive polyurethanes, dendrimers and polymers based upon C6 and C8 fluorotelemer-derived acrylates.

2. The composition according to claim 1, wherein the water-repellent treatment is selected from polysiloxanes and polymers based upon C6 and C8 fluorotelemer-derived acrylates.

3. The composition according to claim 2, wherein the alkyl polyglucoside comprises a hydrophilic end to the molecule with a formula $(C_6H_{10}O_5)n$, where n is at least 1, and a hydrophobic end to the molecule comprising an alkyl group having from 8 to 12 carbon atoms.

4. The composition according to claim 1, wherein the alkyl polyglucoside comprises a hydrophilic end to the molecule with a formula $(C_6H_{10}O_5)n$, where n is at least 1, and a hydrophobic end to the molecule comprising an alkyl group having from 8 to 12 carbon atoms.

5. The composition according to claim 1, wherein the alkyl polyglucoside comprises a hydrophilic end to the molecule with a formula $(C_6H_{10}O_5)n$, where n is at least 1, and a hydrophobic end to the molecule comprising an alkyl group having from 10 to 16 carbon atoms.

6. The composition according to claim 1, wherein the salt is zirconium acetate, titanium lactate or hafnium acetate.

7. The composition according to claim 2, wherein the salt is zirconium acetate, titanium lactate or hafnium acetate.

8. The composition according to claim 2, wherein the water-repellent treatment comprises polymers based upon C6 and C8 fluorotelemer-derived acrylates.

9. The composition according to claim 4, wherein the alkyl polyglucoside comprises a hydrophilic end to the molecule with a formula $(C_6H_{10}O_5)n$, where n is at least 1, and a hydrophobic end to the molecule comprising an alkyl group having from 8 to 10 carbon atoms.

10. The composition according to claim 5, wherein the alkyl polyglucoside comprises a hydrophilic end to the molecule with a formula $(C_6H_{10}O_5)n$, where n is at least 1, and a hydrophobic end to the molecule comprising an alkyl group having from 10 to 12 carbon atoms.

11. A kit for cleaning and/or washing down and/or feathers and rendering the down and/or feathers water repellent comprising (i) a closed vessel containing a solution of a polyglucoside comprising a hydrophilic end to the molecule with a formula of $(C_6H_{10}O_5)n$, where n is at least 1, and a hydrophobic end to the molecule comprising an alkyl group having from 8 to 16 carbon atoms;

(ii) a closed vessel containing a solution of a salt of titanium, zirconium or hafnium and the salt is a selected from acetate and lactate;

(iii) a closed vessel containing a water repellent treatment selected from the group consisting of polysiloxanes, stearic acid-melamine based systems, reactive polyurethanes, dendrimers and polymers based upon C6 and C8 fluorotelemer-derived acrylates.

12. The kit according to claim 11, additionally comprising instructions for use.

13. The kit according to claim 11, wherein the salt is zirconium acetate, titanium lactate or hafnium acetate.

14. The kit according to claim 11, wherein the water-repellent treatment comprises polymers based upon C6 and C8 fluorotelemer-derived acrylates.

15. The kit according to claim 11, wherein the water-repellent treatment comprises a polysiloxane.

* * * * *